US009784254B2

(12) United States Patent
Bradford, Jr.

(10) Patent No.: US 9,784,254 B2
(45) Date of Patent: Oct. 10, 2017

(54) TUBING INSERTED BALANCE PUMP WITH INTERNAL FLUID PASSAGEWAY

(71) Applicant: Floyd John Bradford, Jr., Houston, TX (US)

(72) Inventor: Floyd John Bradford, Jr., Houston, TX (US)

( * ) Notice: Subject to any disclaimer, the term of this patent is extended or adjusted under 35 U.S.C. 154(b) by 610 days.

(21) Appl. No.: 13/815,466

(22) Filed: Mar. 6, 2013

(65) Prior Publication Data

US 2014/0178210 A1 Jun. 26, 2014

Related U.S. Application Data

(63) Continuation-in-part of application No. 13/694,683, filed on Dec. 21, 2012.

(51) Int. Cl.

| | |
|---|---|
| ***F04B 7/02*** | (2006.01) |
| ***F04B 47/02*** | (2006.01) |
| ***F04B 47/04*** | (2006.01) |
| ***F04B 53/10*** | (2006.01) |
| ***F04B 53/22*** | (2006.01) |

(52) U.S. Cl.

CPC ..... *F04B 7/02* (2013.01); *F04B 47/02* (2013.01); *F04B 47/04* (2013.01); *F04B 53/10* (2013.01); *F04B 53/22* (2013.01)

(58) Field of Classification Search

CPC ..... F04B 53/01; F04B 53/22; F04B 47/02; F04B 7/02; F04B 53/10; F04B 7/02; F04B 47/04

USPC ..... 417/238, 545, 399, 56, 555.2, 60, 448, 417/437, 451, 481

See application file for complete search history.

(56) References Cited

U.S. PATENT DOCUMENTS

| | | | | | |
|---|---|---|---|---|---|
| 1,337,593 | A | * | 4/1920 | Coulson | F04B 53/128 417/431 |
| 1,450,215 | A | * | 4/1923 | Maegly | 417/451 |
| 2,058,455 | A | * | 10/1936 | Huff | 417/378 |
| 2,154,331 | A | * | 4/1939 | Hathcock | 417/453 |
| 2,166,612 | A | * | 7/1939 | Scott | 417/448 |
| 2,191,369 | A | | 2/1940 | Chenault | |
| 2,266,094 | A | | 12/1941 | Tebbetts | |
| 2,384,173 | A | | 9/1945 | Johnson | |
| 2,453,365 | A | | 11/1948 | Ferguson | |
| 2,544,094 | A | | 3/1951 | Knowles | |
| 2,642,803 | A | * | 6/1953 | Morris et al. | 166/54.1 |
| 2,679,806 | A | | 6/1954 | Chenault | |
| 2,837,029 | A | | 6/1958 | Mohnkern | |
| 2,906,210 | A | * | 9/1959 | Mason | 417/449 |

(Continued)

*Primary Examiner* — Devon Kramer
*Assistant Examiner* — Lilya Pekarskaya

(57) ABSTRACT

Pump assemblies for use with a subsurface fluid reservoir include an upper portion connected to a fluid conduit extending to the surface, a lower portion connected to the upper portion and in fluid communication with a fluid reservoir of the wellbore, and a plunger assembly movably located within the upper and lower portion of the pump assembly. As the fluid pressure within the tubing string, fluidly isolated from the fluid conduit, increases, fluid is forced into the pump assembly moving the plunger assembly upwell to draw fluid into the pump and forces fluid into the fluid conduit. As the fluid pressure within the tubing string decreases, movement of the plunger assembly forces fluid from the lower portion into the upper portion through a fluid passageway extending through the plunger assembly.

22 Claims, 2 Drawing Sheets

(56) References Cited

U.S. PATENT DOCUMENTS

| | | | | | |
|---|---|---|---|---|---|
| 3,015,280 | A * | 1/1962 | King | 417/401 | |
| 3,034,440 | A * | 5/1962 | Hermanson | 417/238 | |
| 3,048,115 | A * | 8/1962 | Musser | 417/393 | |
| 3,304,871 | A * | 2/1967 | Scroggins | 417/402 | |
| 3,374,746 | A | 3/1968 | Chenault | | |
| 4,219,311 | A | 8/1980 | Simon | | |
| 4,297,087 | A | 10/1981 | Akkerman | | |
| 4,297,088 | A | 10/1981 | Akkerman | | |
| 4,492,536 | A * | 1/1985 | Gilbertson | F04B 47/08 | 417/401 |
| 4,597,722 | A | 7/1986 | Tichy | | |
| 4,768,595 | A * | 9/1988 | Smith | 166/369 | |
| 6,155,803 | A * | 12/2000 | Curington et al. | 417/383 | |
| 7,048,522 | B2 * | 5/2006 | Bradford, Jr. | 417/555.1 | |
| 7,150,315 | B2 * | 12/2006 | Michael et al. | 166/68.5 | |
| 2014/0238688 | A1 * | 8/2014 | Blankenship | E21B 43/121 | 166/369 |

* cited by examiner

TUBING INSERTED BALANCE PUMP WITH INTERNAL FLUID PASSAGEWAY

CROSS-REFERENCE TO RELATED APPLICATIONS

The present application is a continuation-in-part application claiming priority to the co-pending U.S. patent application having the Ser. No. 13/694,683, entitled "Tubing Inserted Balance Pump," filed Dec. 21, 2012, the entirety of which is incorporated by reference herein.

FIELD

Embodiments of the present invention relate, generally, to systems and methods usable in subsurface pumps for removing fluids (e.g., hydrocarbons) from subterranean reservoirs, and more particularly, to rodless pumping systems and methods.

BACKGROUND

Presently, low pressure reservoirs, incapable of producing fluid from the reservoir to the surface naturally, account for a majority of the hydrocarbon producing wells in the United States. There are various means of pumping fluid from these wells, such as the use of sucker rod pumps, hydraulic pumps, jet pumps, and semi-submersible electric pumps. Most of these depleted wells produce fluid at pressure and flow rates too low for the majority of existing pumps to operate efficiently and/or economically.

The most common method used for producing these low pressure, low flow rate wells is the use of sucker rod pumping systems. Sucker rod pumping systems include a downhole plunger and cylinder type pump, connected to a surface unit (e.g., a pump jack) by connecting rods (e.g., sucker rods). Existing sucker rod systems include multiple limitations and difficulties inherent in their use. While the stroke length of the pump and the stroke frequency may be controlled through the selection of the pump jack size, pumping jacks are too costly, and each pump size is limited to a specific range of flow rates and depth of the reservoir. Once a pump unit is placed, it is cost prohibitive to change the pump jack, thus modification of stroke length and/or frequency is often impossible. Another large problem with conventional sucker rod systems relates to the sucker rods, themselves. Sucker rods include segments of metal or fiberglass rod that are connected together to form a continuous string of rods, normally several thousand feet in length when used in hydrocarbon wells. These rod strings are typically connected using pin and box connections (e.g., threaded connections). The process of connecting the rod string when running sucker rod segments into a wellbore, or disconnecting the string when removing rod segments from the wellbore, is time consuming and costly. Additionally, the length and weight of these rods and the repeated reciprocation of the rods caused by the pump jack often results in failure, commonly by a parting of the sucker rod string. Another difficulty associated with the use of sucker rod strings is the position of the rod string within a tubing string (e.g., production tubing). When the system is operating, it is common for the rod string to contact the inner wall of the tubular string at various points, which results in wear of both the rod string and the tubular string, and can eventually cause failure of the well tubing string, as well as the rod string. Depending of the severity of the wellbore conditions, rod pumping systems fail on the average of once a month, quarterly, or semiannually, requiring significant repair and maintenance costs. The frequency and expense of necessary repairs and maintenance is often a significant factor that causes production of a well to become uneconomical. Failure rates in rod pumping systems are significantly more common in deviated and/or non-vertical wellbores.

There have been attempts to develop a pumping system which utilizes a plunger/cylinder-type downhole pump while eliminating the use of sucker rods, thereby eliminating the problems inherent in the use of sucker rods. Existing rodless pump systems typically include a surface unit, which is connected to a subsurface pump by a fluid conduit, such as the tubing string. The surface unit activates the subsurface pump by applying pressure to the fluid in the tubing string to compress a spring or similar member in the subsurface pump and displace a slidable piston, which thereby draws fluid from the wellbore into a pump chamber. When the surface unit releases the fluid pressure, a spring mechanism in the subsurface pump will displace the piston and lift the fluid from the pump chamber into the tubing string and toward the surface. Although, such systems eliminate use of a sucker rod string, they require a compression spring for lifting the produced fluid into the tubing string. Use of such a spring severely limits the stroke length and thus, the flow rate of the pump. Further, springs used in this manner tend to fail due to wear and/or the accumulation of debris carried into the pump.

Other existing rodless pumps replace the physical spring with a gas chamber. When pressure is applied to the tubing string, a piston will compress the gas within the chamber, and when the pressure is relieved, the gas will expand to lift fluid into the tubing string. These systems allow for a longer stroke length and thus much higher efficiency, but introduce additional problems. A major problem inherent in the use of rodless pumps is that, unlike sucker rod pumps, a rodless pump does not have a precisely defined stroke length. In a rodless pump, the stroke length is affected by the length of time the surface unit applies pressure to the fluid in the tubing string during each cycle, by the compressibility of the fluid in the tubing string, and by the amount of ballooning of the tubing that occurs. The stroke length is also influenced by the pressure in the gas chamber, since the pressure in the gas chamber must be sufficient to support the hydrostatic pressure of the entire column of fluid extending to the surface. At the end of each downstroke, enough force is applied to the plunger to cause the plunger to strike the bottom of the barrel with a significant impact, causing excessive wear and potential damage. Also, because the surface unit is unable to stop applying pressure to the tubing string at the precise moment necessary to prevent this contact, the plunger will also impact the limit stop at the end of each upstroke. Thus, unlike sucker rod pumps, rodless pumps are difficult to design in a manner that enables the maximum stroke to be utilized without the plunger contacting the barrel at the end of the upstroke and downstroke, severely limiting the usable life of such pumps.

Other rodless pumps attempt to overcome these severe plunger impacts through use of dampening mechanisms, such as elastomer barriers, springs, and/or other types of dampeners, at both the top and bottom of the plunger's stroke. However, such rodless pump systems still utilize a downhole gas source within the pump to force the plunger assembly downward after the surface pressure source releases the pressure being exerted on the downhole pump. The gas pressure source requires a substantially self-contained pressure chamber, which can be part of the pump, can be positioned downhole, and can be used to contain a substantially compressible fluid. The pressure chamber can be precharged with a gas, such as nitrogen. Although this arrangement is an improvement over preceding pumps, particularly those subject to plunger impact, it still possesses inherent limitations. For example, this arrangement of pump requires a very high precharge pressure in the gas chamber, the pump will suffer from a short piston life due to fluid leakage and contamination, and the pump will require bleeding the substantial gas chamber pressure whenever retrieving the pump to the surface.

Embodiments usable within the scope of the present disclosure improve upon these and other existing designs by eliminating the use of rods, pump jacks, springs, and downhole gas sources or gas pressure chambers within the pump to meet the need for a rodless pump that is operable downhole without plunger impact problems and having a substantial usable life.

Another limitation associated with existing pumps is the requirement of a housing structure, which surrounds sections of the pump, as a means of engagement. To install such a pump, the tubing string, such as production tubing, must be extracted from the well, such that the pump can be connected at the end of the tubing string (e.g., via threading the housing to the tubing). The pump is then lowered into the well by lowering the tubing string. This undertaking requires a significant quantity of manual labor and well downtime, resulting in significant costs and losses of revenues. Furthermore, most repairs to these types of pumps also require the extraction of the entire tubular string to access the pump, which requires a major rig to handle the weight.

Embodiments usable within the scope of the present disclosure improve upon these and other existing designs by eliminating the use of wide housing, thereby meeting the need for a subsurface pump that can be inserted and extracted from and/or through the tubing string without requiring extraction of the tubing string itself.

However, pumps that do not contain a housing structure, and are inserted directly into the existing tubing string, can be faced with certain problems. Because such pumps have small barrel and plunger diameters, they are normally capable of moving only small volumes of produced hydrocarbons with each stroke. One system that can overcome this limitation is a system that includes a pump with an increased stroke length. Pumps having longer stroke lengths, however, can be encumbered with problems, such as piston shaft buckling, ineffective sealing between the pistons and the pump barrel, and significant barrel strains due to deep well pressures. Embodiments usable within the scope of the present disclosure improve upon existing systems and methods of use to meet the needs for a subsurface pump having an increased stroke length, which is operable downhole without piston shaft buckling and problems associated with sealing and barrel deformation.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products, and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 1:
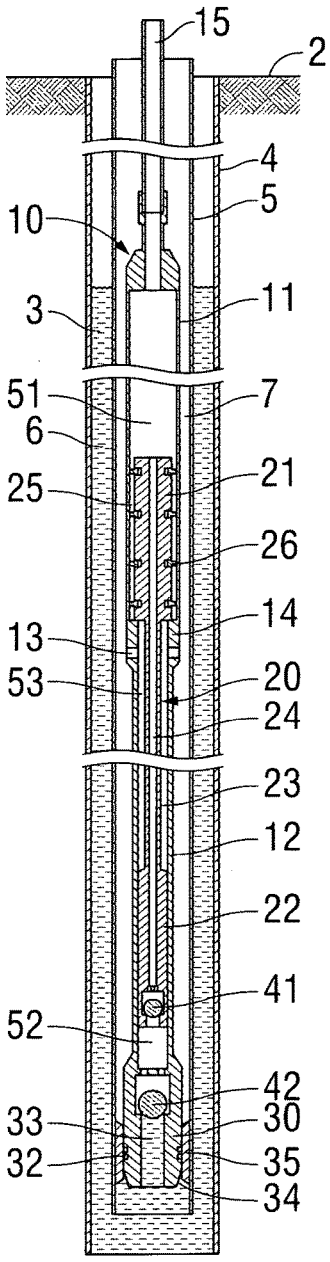
FIG. 1 is a cross-sectional conceptual view of an embodiment of a pump usable within the scope of the present disclosure as it is positioned within the tubing string and the well bore, with the plunger assembly at the lowest position of a pump stroke.

Referring now to FIG. 1, a cross-sectional view of an embodiment of a subsurface pump (10) usable within the scope of the present disclosure is shown. The depicted subsurface pump is inserted into a tubing string (e.g., production tubing) and mounted within the tubing string (5) at its lower end. The tubing string (5) extends to the surface (2) of the wellbore (4), wherein the tubing string (5) can be fluidly connected to a surface pumping unit (not shown), which can be usable to force fluid down the tubing string (5) (e.g. by applying pressure to the fluid in the tubing string) to actuate the subsurface pump (10). As further depicted in FIG. 1, the pump includes an upper portion called an upper barrel (11), a lower portion called a lower barrel (12), and a plunger assembly (20), which includes an upper plunger (21), a lower plunger (22), and a connecting shaft (23) extending therebetween. The plunger assembly (20) can be movably disposed within the upper and lower barrels (11, 12), as described in more detail below. As described below, as the pressure of the fluid in the tubing string (5) increases, the fluid in the tubing string (5) is forced into the pump assembly (10) through annular ports (13) to actuate the plunger assembly (20), therefore the fluid located within a tubing string may be referred to as an actuating fluid. In addition, it will be understood that directional terms such as up, upper, or top, used herein, describe a relative position in the upwell direction, meaning the direction along the axis of the wellbore (4) towards the surface (2). Whereas, terms such as down, lower, below, or bottom, used herein, describe a relative position in the downwell direction, meaning the direction along the axis of the wellbore (4) away from the surface (2).

During typical operation, the pump (10) can be positioned toward the downwell end of the tubing string (5), within the reservoir (3) area. A casing may be inserted into the wellbore (4) to prevent the walls of the wellbore from collapsing. The wellbore (4) and the casing include perforations formed in the side walls thereof to permit fluid to flow from a well production zone into the wellbore (4), such that a wellbore fluid annulus (6), between the wellbore (4) and the tubing string (5), can be filled with production fluid. The area of the wellbore fluid annulus (6) and the area below the pump assembly (10), filled with production fluids, will hereafter be referred to as the reservoir (3). As described in detail below, the production fluid is pumped through the various components of the pump assembly (10), up a fluid conduit (15), and to the surface (2). It should be understood, however, that embodiments usable within the scope of the present disclosure could be used within uncased wellbores.

Figure 3:
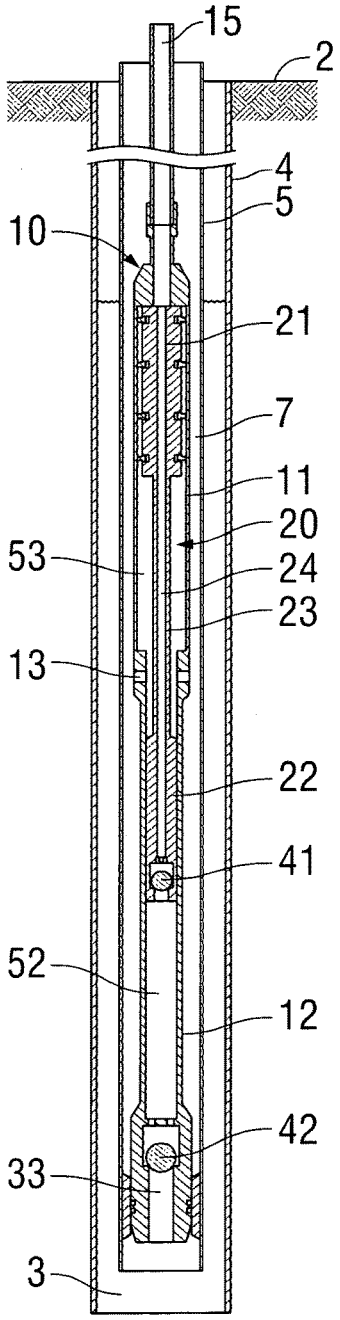
FIG. 3 is a cross-sectional view of the pump of FIG. 1, as the plunger assembly reaches the top position of an upstroke.

As depicted in FIGS. 1 and 3, the subsurface pump (10) includes a tube mounting section (30) at the lower end of the pump (10). The tube mounting section (30) is configured to securely mate and/or attach the pump (10) to a seating nipple (35), which can be located in the lower end of the tubing string (5). The seating nipple (35) can be a standard type commonly used with sucker rod pump installation. Thus, the subsurface pump (10) can replace a sucker rod pump, typically used in a standard rod pump system, without requiring removal and/or retrieval of the tubing string (5) for installing special seating nipples (35). The tube mounting section (30) can be configured to include rubber o-ring seals (32) or other sealing members to prevent fluids from breaching the seal (e.g., bypassing the pump) when the tube mounting section (30) is engaged with a corresponding seating nipple (35). It should be understood that the manner of sealing the pump (10) against the seating nipple (35) can include any type, configuration, number, and/or combination of sealing elements, including elastomeric seals, metal-to-metal seals, or other types of sealing materials. FIG. 1 also depicts the tube mounting section (30) having a chamfered end (34), which aids insertion into the seating nipple (35) by guiding the tube mounting section (30) into the engaged position.

At the upwell end of the pump (10), FIG. 1 further depicts a fluid conduit (15) (e.g. a fluid passageway), which is connected to the pump (10) at the upwell end of the upper barrel (11). The fluid conduit (15), along with the tubing string (5), communicates fluids between the surface (2) of the wellbore (4) and the pump (10). FIG. 1 depicts the upper barrel (11) being adapted for connecting to the fluid conduit (15), which is positioned within, but fluidly isolated from, the tubing string (5) and is connected to a fluid container (not shown) located at the surface (2) of the well. The tubing string (5) can be connected to a surface pumping unit (not shown), such as a hydraulic pump having a timed cycle for controlling the upstroke and downstroke of plunger assembly (20). The combination of the tubing string (5) and the fluid contained therein eliminates the need for use of a downhole gas chamber or a spring mechanism, normally required to push the production fluid to the surface (2). The fluid located within the tubing string (5) may be any fluid compatible with the pump assembly (10) and can include fluids which were previously produced from the reservoir (3) or any other hydrocarbons. It should be understood that the manner in which the fluid conduit (15) is connected to the upper barrel (11) can include any means known in the art. For example, the two components can be engaged to one another using a threaded connection, by welding, by crimping, using a forced or interference fit, using one or more fasteners, or by using any other means of attachment known in the art.

As shown in FIG. 1, the downwell end of the pump (10) includes a lower barrel (12). As depicted, the inside diameter of the lower barrel is preferably smaller than the inside diameter of the upper barrel (11). At the downwell end of the pump, an inlet port (33) is located, which communicates production fluid from the reservoir (3) into the lower barrel (12). A standing check valve (42) is shown positioned at the inlet port (33), below the plunger assembly (20), and provides selective fluid communication between the production fluid in the reservoir (3) and the lower barrel (12). As explained in more detail below, the standing check valve (42) allows production fluid from the reservoir (3) to flow into the lower barrel (12) and prevents the flow of fluid from within the lower barrel (12), outwardly, into the reservoir (3).

FIG. 1 depicts a transition portion (14) located between the upper barrel (11) and the lower barrel (12), which allows the larger diameter upper barrel (11) to connect to a smaller diameter lower barrel (12). The transition section (14) can contain a plurality of fluid ports or annular ports (13), which allow fluid communication between the tubing string annulus (7) and the central cavity (53) area. It should be understood that while the annular ports (13) are shown within the transition portion (14) of the upper barrel, such ports are preferably located below the lowermost position of the upper plunger (21) and above the uppermost position of the lower plunger (22). The annular ports (13) can provide fluid communication between the fluid in the tubing string annulus (7) and the central cavity (53), allowing the pressurized fluid to enter the pump (10), to lift the plunger assembly (20) upwards, and to exit the pump (10) as the plunger assembly (20) moves downwards.

Referring specifically to the plunger assembly (20), FIG. 1 depicts a plunger assembly (20) comprising an upper plunger (21), a shaft (23), a lower plunger (22), and a traveling valve (41). The plunger assembly (20) contains a fluid passageway (24) extending through the longitudinal center of upper plunger (21), the shaft (23), and the lower plunger (22), allowing one-way fluid communication between the lower cavity (52) area, located below the lower plunger (22), and the upper cavity (51) area, located above the upper plunger (21). The plunger assembly (20) is movably positioned within the pump (10). Specifically, the upper plunger (21) moves within the space inside the upper barrel (11), and the lower plunger (22) moves within the space inside the lower barrel (12). The upper and lower plungers (21, 22) are connected by a shaft (23) having a central fluid passageway (24). The plunger assembly (20) may be of unitary construction or of various connected assemblies, and may be formed from any suitable material (e.g., metal or a metal alloy), preferably a material that is corrosion resistant, especially against salt water.

Although FIG. 1, depicts a shaft (23) comprising an outside diameter that is significantly smaller than both the upper and lower plungers (21, 22), the shaft (23) may comprise a diameter that is equal to or substantially equal to the outside diameter of the lower plunger (22). In another embodiment of the pump (10), the shaft (23) may be omitted altogether, having the lower plunger (22) connected directly to the upper plunger (21). In either embodiment, the annular ports (13) are fluidly connected with the bottom surface of the upper plunger (21), enabling the plunger assembly (20) to be forced in the upward direction by incoming fluid.

As mentioned above and further depicted in FIGS. 1 and 2, several volumetric areas exist within the pump (10). The volumetric area within the upper barrel (11), formed above the upper plunger (21) and below the fluid conduit (15), is termed the upper cavity (51). The upper cavity (51) is fluidly connected with the fluid conduit (15). The volumetric area within the lower barrel (12), formed below the lower plunger (22) and above the standing check valve (42), is termed the lower cavity. The lower cavity (52) is fluidly connected with the fluid reservoir (3). The area within the upper and lower barrels (11, 12), formed between the upper plunger (21) and the lower plunger (22), is termed the central cavity (53). The central cavity (53) is fluidly connected with the tubing string annulus (7). As fluids are forced into and out of the cavities (51, 52, 53), the plunger assembly (20) moves upwell and downwell within the pump (10), and the volumetric areas of the cavities are simultaneously expanded or reduced.

Referring again to the plunger assembly (20) depicted in FIG. 1, in an embodiment, the upper plunger (21), located on the upwell end of the plunger assembly (20), can be a cylindrical member having a fluid passageway (24) extend through the upper plunger (21) along its longitudinal center, and can include sealing elements (26) on the outside surface to prevent fluids from breaching the seal during pump operation. Usable sealing means are described in more detail below.

The lower plunger (22) depicted in FIG. 1, can include a cylindrical member located at the downwell end of the plunger assembly (20). Like the upper plunger (21), the lower plunger (22) is configured with a fluid passageway (24) extending therethrough, along its longitudinal center, allowing production fluids to pass through at specific stages of pump operation. A traveling valve (41) is shown at the bottom end of the fluid passageway (24), at the bottom of the lower plunger (22), for providing selective fluid communication between the lower cavity (52) and the upper cavity, (51) through the fluid passageway (24). Specifically, the traveling valve (41) can be a flow control valve, such as a check valve, which prevents flow through the fluid passageway (24) in the downwell direction and allows fluid to pass in the upwell direction, as the plunger assembly (20) is moving in the downwell direction. The traveling valve (41) can be of any type, including a valve having a gravity actuated flow restricting element, such as a ball (as depicted in FIG. 1), such that gravity can retain the flow restricting element on the valve seat. The traveling valve (41) can include a spring assisted valve, wherein a spring retains the flow restricting element on the valve seat, or other types of one-way valves known in the art.

Figure 2:
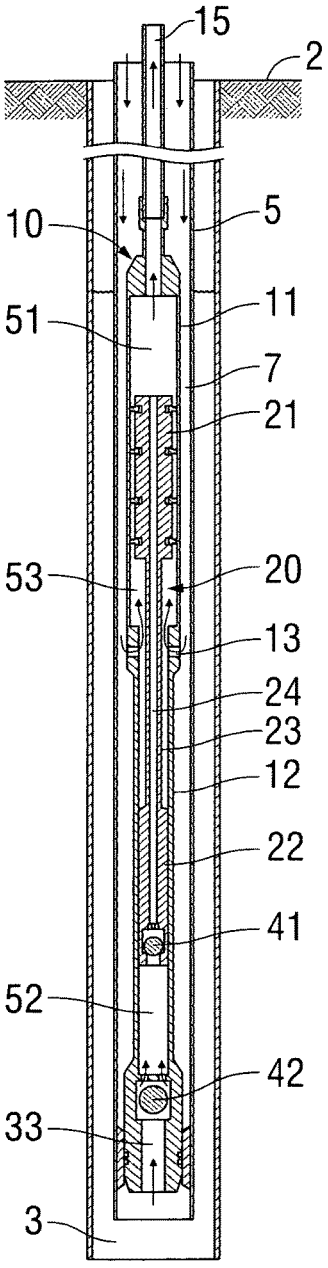
FIG. 2 is a cross-sectional view of the pump of FIG. 1, with the plunger assembly moving in the upward direction in response to the application of pressure from a surface pumping unit to the fluid in the tubing string.
Figure 4:
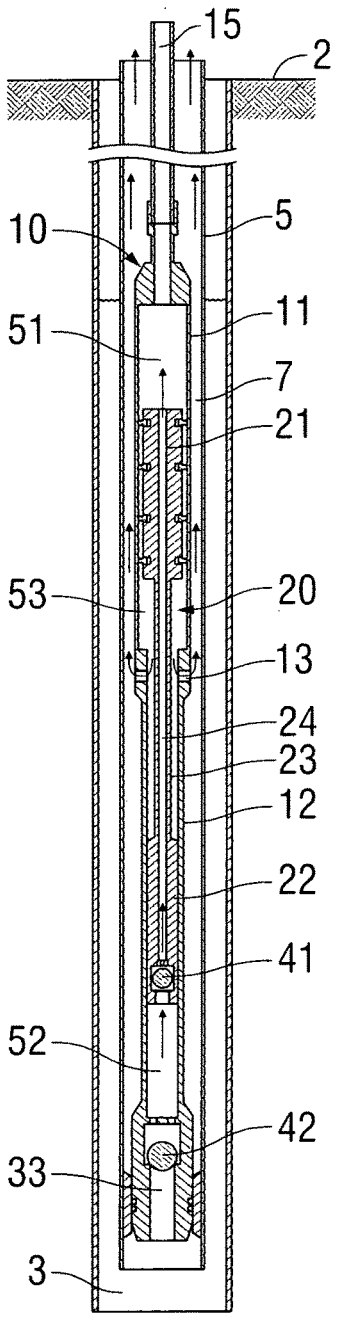
FIG. 4 is a cross-sectional view of the pump of FIG. 1, with the plunger assembly moving in a downwell direction in response to a release of pressure introduced by the surface pumping unit to the fluid in the tubing string, and the application of hydrostatic pressure from fluid contained in the fluid conduit.

Embodiments of the plunger assembly (20), as disclosed above, require little or no compression forces to be applied to the shaft (23) during the operation of the pump (10). As is known in the industry, compressive forces tend to cause buckling in shafts, especially longer shafts. During the down-stroke phase of the pumping operations, as depicted in FIG. 4, production fluid flows through the traveling valve (41) at insignificant or very low pressure differentials, resulting in insignificant or low compression forces being generated in the shaft (23). Consequently, the current pump design allows the incorporation of longer shafts (23) than utilized in conventional subsurface pumps, and in turn, enables an increased stroke and pumping capacity. Conversely, during the up-stroke phase of the pumping operations, as depicted in FIG. 2, the shaft (23) is in tension, which has no effect of shaft buckling. Production fluid also ceases to flow through the fluid passageway (24), as the traveling valve (41) closes. In the embodiment depicted in FIG. 2, the stroke length is 24 feet; however, other embodiments, having strokes greater or less than 24 feet are also possible. The lengths of the plungers (21, 22) can vary depending on the overall length and stroke length of the pump (10). As described above, the shaft (23) can comprise a larger outside diameter than depicted in FIG. 1, giving it additional structural properties to resist shaft buckling and enable longer strokes.

In embodiments of the pump (10) as depicted in FIG. 1, the outside diameter of the upper and lower plungers (21, 22) are sized and/or adapted to slide within the corresponding barrels (11, 12). In said embodiments, the clearance of the engineering fit between the plungers (21, 22) and the barrels (11, 12) should be sufficiently close to facilitate a formation of a fluid seal between the two sets of components, but at the same time, allow the plungers (21, 22) to slide freely within the barrels (11, 12). Therefore, one or both of the plungers (21, 22) can contain small clearances and no additional sealing elements, relying only on metal-to-metal sealing between the plungers (21, 22) and the barrels (11, 12) to isolate fluids between the upper, lower, and central cavities (51, 52, 53). In another embodiment, one or both of the plungers (21, 22) can contain additional sealing elements incorporated thereon, in order to further prevent such fluids from leaking between the cavities (51, 52, 53) during pump operation. Sealing elements such as o-rings, sealing rings, lip seals, cups, and/or other similar sealing elements, can be used.

During pumping operations, the plungers (21, 22) can impact the upper and lower barrels (11, 12) with significant force, which can result in pump damage or premature wear. In an embodiment as depicted in FIG. 1, the pump (10) can include dampening mechanisms (not shown) at both the top and bottom of the plunger stroke, so as to reduce metal to metal impact within the pump. Dampening mechanisms, such as those disclosed in U.S. Pat. Nos. 6,155,803 and 7,048,522, which are incorporated herein in their entirety by reference, as well as other dampening mechanisms can be utilized with the disclosed pump (10).

As it is desirable that the pump (10) be inserted into tubing string (5) and, at the same time, maintain the largest possible internal volume, embodiments of the present pump can include barrels (11, 12) having wall thicknesses less than that of conventional downwell pumps. The thin walls of the pump (10) can be more susceptible to high hydrostatic pressures associated with deep wells, and can undergo significant deformations when lowered to greater depths. At such depths, the barrel (11, 12) walls may be compressed and the inside diameter of the pump (10) narrowed to a point where contact and/or friction between the plungers (21, 22) and barrels (11, 12) causes the plungers (21, 22) to become unable to reciprocate within the barrels (11, 12). To prevent such seizure, the outside diameters of the plungers (21, 22) can be sized to be significantly smaller than the inside diameters of the barrels (11, 12). However, as shown in FIG. 1, incorporating a relatively large clearance (25) in the fit, between the upper barrel (11) and the upper plunger (21), can result in fluids leaking between the upper and central cavities (51, 53).

To solve this problem, the outside surface of the plungers (21, 22) can be configured to include sealing elements to prevent such fluids from leaking during pump operation. Sealing elements such as lip seals, cups, and/or sealing rings, and other similar sealing elements, can be used. For example, sealing rings (26) shown in FIG. 1, may be provided, having a single piece, a multiple piece, or spring backed construction. For optimal operation, the seals can be sized to close the gap or the annular space between the upper barrel (11) and the upper plunger (21), and the seals can possess the ability to adjust in height as the upper plunger (21) moves laterally within the upper barrel (21) during operation. This can be achieved, for example, by incorporating sealing elements, comprising flexible material, which are then compressed as the upper plunger moves relative to the barrel walls. Another example is a sealing ring (26), which can float in a deep groove having a diameter that is smaller than the inside diameter of the sealing ring (26). As depicted in FIG. 1, the sealing rings (26) can be pushed by the upper barrel (11) wall into the grooves on one side of the upper plunger (21) and extend out of the groove on the other side, as the upper plunger (21) moves laterally, within the upper barrel (11), relative to the longitudinal axis of the upper barrel (11). In still another embodiment, the sealing ring (26) may be centered about the upper barrel (11) by a spring. It should be understood that the sealing means described can include any type and/or combination of sealing elements and any arrangement thereof, to optimize performance of the pump. It should also be understood that the upper plunger (21), the lower plunger (22), or both plungers (21, 22), may include the clearance and sealing configuration, as described above.

Several significant improvements can be attributed to the novel configuration of the pump (10) as disclosed. For example, embodiments of the present pump (10) can allow for a stroke that may be 10, 15, 20 feet in length or longer. Due to such long strokes, the pump cycle frequency can be significantly lowered when compared to conventional pumps, resulting in reduced wear, and extending the life of the pump. Furthermore, as shown in FIG. 1, the length and the thin walls of the pump barrels (11, 12), the large clearance (25) fit between the upper barrel (11) and the upper plunger (21), enable the pump (10) to flex and withstand significant bending in the wellbore while maintaining fluid sealing, which further allows the pump (10) to be lowered through tight corners and to pump fluids to the surface (2), while being positioned within a deviated well or directional well.

As the thin barrel walls require less lateral forces to bend, the pump (10) flexes more easily with less internal stresses (e.g. tension, compression, shear, etc.) being generated within the barrel (11, 12) walls during lowering and retrieval into or from a wellbore (4). As a result, the barrel walls experience lesser internal strains and, therefore, a lesser chance of permanent deformation in the pump structure. Also, a large clearance (25) fit between the barrel walls and the upper plunger (21) can result in a range of motion (e.g., "play") between the two components, which can allow the barrels (11, 12) to bend substantially without interfering with the upper plunger (21). Furthermore, the length of the upper plunger (21) enables the pump (10) to flex without resulting in high local forces being applied to the barrel walls, which can result in permanent deformation in the pump structure. During pump insertion through a deviated wellbore or during pumping operations performed in a deviated wellbore, contact between the upper plunger (21) and the upper barrel (11) walls can result. Such contact can introduce high forces and stresses in the upper barrel (11) walls, causing permanent deformation therein. A longer plunger (21) contains a larger surface area contacting the walls of the upper barrel (11), which results in greater distribution of lateral forces between the two parts. Greater distribution of contact forces result in smaller stresses between the upper barrel (11) and upper plunger (21), decreasing the chances of permanent damage to the upper barrel (11) and/or the upper plunger (21). Lastly, a larger surface area of contact between the upper plunger (21) and upper barrel (11) allows for improved sealing. Larger surface area between the upper barrel (11) and the upper plunger (21) result in an increased sealing area between the two parts, reducing fluid leakage between the two parts. Larger surface area between the two components also provides more space for additional sealing elements, which further improve the ability to prevent fluid leakage. In different embodiments of the pump (10), each plunger (21, 22) can have any length that can seal against the barrels (11, 12), wherein the lengths can be 10 feet, or longer, depending on well conditions.

Referring again to FIG. 1, in a common oilfield application, the pump (10) can be inserted into a tubing string (5) and slid down until the mounting section (30) mates with and seals against the seating nipple (35) located at the bottom of a tubing string (5), within the reservoir (3) fluid to be produced. A fluid conduit (15) can be connected to the upper barrel (11) portion of the pump (10), prior to, during, or after pump insertion, allowing the communication of the production fluid between the upper cavity (51) of the pump (10) and the well surface (2). A pressure source, such as a hydraulic pump (not shown), can be connected to the tubing string (5), at the surface, to enable selective application of pressure into the tubing string (5) for actuating the downhole pump (10). Although the fluid conduit (15) is shown positioned inside the tubing string (5), the respective fluids contained therein are isolated, which enables fluid in the tubing string (5) to be pressurized, while fluid pressure inside the conduit (15) remains the same. As hydrostatic pressures within the tubing string (5) and the conduit (15) are determined by the height of each respective fluid column, when no external pressure is introduced, there is a tendency towards substantial balancing of pressures between the actuating fluid in the tubing string (5) and the production fluid in the conduit (15).

During the upstroke phase of pump operation, depicted in FIG. 2, the pressure in the fluid conduit (15) can be exceeded by the pressure in the tubing string (5), as the fluid within the tubing string (5) is pressurized by the surface pump (not shown). As shown in the embodiment depicted in FIG. 2, actuating fluid can be communicated from the tubing string (5) into the central cavity (53) through the annular ports (13) and can proceed to lift the plunger assembly (20) in the upward direction. As a result, the production fluid in the upper cavity (51) can be pushed upwards into and through the conduit (15). As the plunger assembly (20) reaches its upper most position, depicted in FIG. 3, the pressure introduced by the surface pump is reduced or the surface pump is fully disconnected from the tubing string (5), so the pressure introduced into the actuating fluid by the surface pump is reduced or released (i.e. the tubing string is depressurized). Consequently, the hydrostatic pressures of the fluid column within the conduit (15) and the tubing string (5) equalize about the plunger assembly (20), resulting in no net force being applied thereto. At this point, the plunger assembly (20) is free to descend in the downwell direction, due to its weight and higher density as compared to the fluids it is in contact with, until it reaches its lowermost position.

Also, additional pressure can be maintained or utilized within the fluid conduit (15) to force, move, or assist the plunger assembly (20) to move in the downwell direction to its lowermost position. In one embodiment, a vessel or a tank (not shown) containing pressurized fluid can be in fluid communication with the fluid conduit (15), maintaining the fluid within the fluid conduit (15) at a desired pressure, however, other means of maintaining the fluid conduit (15) at a desired fluid pressure, which are known in the art, can be used. Additional pressure in the conduit (15) can assist the plunger assembly (20) to move or descend in the downwell direction faster than by gravity alone.

Referring now to FIG. 4, the plunger assembly (20) is shown descending in the downwell direction, whereby fluid in the lower cavity (52) bypasses the traveling valve (41) and flows through the fluid conduit (24) into the upper cavity (51). Since the volumetric area of the upper cavity (51) is larger than the volumetric area of the lower cavity (52), an amount of fluid, located in the conduit (15), may descend back into the upper cavity (51), as the plunger assembly (20) descends to the lowest position (as depicted in FIG. 1). During subsequent upstroke phase, the fluid previously communicated into the upper cavity (51), during the downstroke phase, can be forced up the conduit (15) while new production fluid is simultaneously drawn into the lower cavity (51) from the reservoir (33).

A more detailed description of the operation of the pump system is described below. This process, as shown in FIGS. 1 through 4 and discussed below, can be repeated for extended periods of time to produce a well.

FIG. 1 shows the plunger assembly (20) at its lowermost position, which is the starting point of each pump stroke. In said position, the pressures of the fluid within the tubing string (5) and the conduit (15) are balanced about the plunger (20). The standing valve and the traveling valve are both closed and no fluid communication between the cavities (51, 52, 53) takes place.

FIG. 2 shows the plunger assembly (20) moving upward. As the surface pump unit (not shown) is activated, fluid is pumped into the tubing string (5) (as shown by the arrows), down the annulus (7), and into the central cavity (53) through the annular ports (13) (as shown by the arrows). The resulting increased pressure in the central cavity (53) forces the plunger assembly (20) upward, due to the diameter of the upper plunger (21) being larger than the diameter of the lower plunger (22). The traveling valve (41) remains closed and the standing valve (42) opens, allowing production fluid (e.g., hydrocarbons) from the reservoir (3) to be drawn, through the inlet port (33), into the lower cavity (52) of the lower barrel (12) (as shown by the arrows). Simultaneously, production fluid located in the upper cavity (51) is forced upwell into the conduit (15) (as shown by the arrows) by the plunger assembly (20).

FIG. 3 shows the plunger assembly (20), within the pump (10), at its uppermost position of the upstroke phase. The surface pump unit (not shown) is continuing to pressurize the fluid within the tubing string (5), maintaining said position. The central cavity (53), which comprises most of the upper barrel (11), is filled with pressurized fluid from the tubing string (5), while the lower cavity (52), which comprises most of the lower barrel (12), is filled with newly drawn fluid from the reservoir (3). The fluid formerly located in the upper cavity (51, shown in FIGS. 1 and 2) has been forced upwell through the fluid conduit (15) and into a storage container (not shown). Both the traveling valve (41) and the standing valve (42) are closed. FIG. 3 also depicts the well surface (2), the tubing string annulus (7), the annular ports (13), the upper plunger (21), the lower plunger (22), the connecting shaft (23), and the fluid passageway (24), and the inlet port (33).

FIG. 4 shows a plunger assembly (20) moving in a downwell direction in response to the hydrostatic pressures within the tubing string (5) and the fluid conduit (15) being balanced. Once the plunger assembly (20) reaches the top of its stroke within the pump (10), as depicted in FIG. 3, the surface pump unit (not shown) is disconnected from the tubing string (5), allowing the pressure therein and the pressure within the fluid conduit (15) to equalize. As a result, the plunger assembly (20) assembly is allowed to descend to its lowermost position, as no net force is applied thereto. During this phase, the standing valve (42) is closed, preventing fluid in lower cavity (52) from escaping into the reservoir (3). The traveling valve (41) is open, allowing fluid to communicate from the lower cavity (52) into the upper cavity (51) (as shown by the arrows). Since the volumetric area of the upper cavity (51) is larger than the volumetric area of the lower cavity (52), some fluid located in the conduit (15) may descend back into the upper cavity (51) as the plunger assembly (20) descends. Simultaneously, the fluid in the central cavity (53) is forced out of the pump (10) and back into the annulus (7) of the tubing string (5) through the annular ports (13) (as shown by the arrows). FIG. 4 also depicts the well surface (2), the upper barrel (11), the lower barrel (12), the upper plunger (21), the lower plunger (22), and the shaft (23).

As described above, FIG. 1 shows the plunger assembly (20) at the bottom of the downstroke, at which time the next pumping cycle can start.

While various embodiments usable within the scope of the present disclosure have been described with emphasis, it should be understood that within the scope of the appended claims, the present invention can be practiced other than as specifically described herein.

What is claimed is:

1. A pump assembly positioned within a tubing string extending between a subsurface fluid reservoir and a well surface, the pump assembly comprising:

an upper barrel connected to a fluid conduit, wherein the fluid conduit extends between the upper barrel and the well surface;

a lower barrel connected to the upper barrel, wherein the lower barrel is in fluid communication with the subsurface fluid reservoir;

a first fluid valve located between the lower barrel and the subsurface fluid reservoir;

a fluid passageway extending through a center of the entire length of the pump assembly from the first fluid valve to the fluid conduit; and a plunger assembly comprising:

an upper plunger movably disposed within the upper barrel;

a lower plunger movably disposed within the lower barrel, wherein the upper plunger and the lower plunger are connected by a connecting shaft; and a central cavity formed within the upper barrel and lower barrel between a bottom of the upper plunger and a top of the lower plunger, wherein the central cavity is in fluid communication with an exterior of the pump assembly, and wherein the plunger assembly moves in a first direction and in a second direction in response to changes in a pressure of an actuating fluid located within the central cavity; and wherein the fluid passageway extends within the plunger assembly through a center of the lower plunger, a center of the upper plunger, and a center of the connecting shaft.

2. The pump assembly of claim 1, wherein the actuating fluid within the tubing string moves the plunger assembly in the first direction as the pressure of the actuating fluid within the tubing string increases, and wherein the plunger assembly moves in the second direction as the pressure of the actuating fluid within the tubing string is released.

3. The pump assembly of claim 1, wherein a production fluid located in the subsurface fluid reservoir is drawn into the lower barrel and the production fluid located in the upper barrel is communicated into the fluid conduit as the plunger assembly moves in the first direction.

4. The pump assembly of claim 3, wherein the actuating fluid located within the tubing string is isolated from the production fluid.

5. The pump assembly of claim 3, wherein the pump assembly further comprises a second fluid valve controlling flow of the production fluid through the fluid passageway, and wherein the fluid passageway communicates the production fluid from the lower barrel to the upper barrel as the plunger assembly moves in the second direction.

6. The pump assembly of claim 1, wherein the plunger assembly moves within the pump assembly and the upper barrel and lower barrel comprise a length ranging from 8 feet to 40 feet each.

7. The pump assembly of claim 1, wherein the upper plunger comprises a length between 0.50 meters (twenty inches) and 6.10 meters (ten feet).

8. The pump assembly of claim 1, wherein the upper plunger is larger than the lower plunger, and wherein the actuating fluid acts upon the larger upper plunger to create a greater force in the second direction, which is an upward direction to raise the plunger assembly.

9. The pump assembly of claim 2, wherein gravitational forces on the plunger assembly cause the plunger assembly to move in the second direction.

10. A pump assembly for pumping a production fluid from a subsurface fluid reservoir, the pump assembly comprising:

an upper barrel connected to a lower barrel, wherein the upper barrel is in fluid communication with a fluid conduit, wherein the fluid conduit extends from the upper barrel to a surface of a well, wherein the lower barrel is in fluid communication with the subsurface fluid reservoir;

a plunger assembly comprising:

an upper plunger movable within the upper barrel;

a lower plunger movable within the lower barrel and connected attached with a connecting shaft to the upper plunger; the plunger assembly movably disposed within the upper barrel and the lower barrel, wherein the plunger assembly comprises a central cavity formed within the upper barrel and the lower barrel between a bottom of the upper plunger and a top of the lower plunger;

a first fluid valve preventing the production fluid from flowing from the pump assembly to the fluid surface reservoir; and a fluid passageway extending from the first fluid valve centrally within and through a center of the upper plunger, a center of the connecting shaft, a center of the lower plunger, the entire length of the pump assembly and through the fluid conduit to the surface of the well, wherein increasing a pressure of an actuating fluid within the central cavity moves the plunger assembly in a first direction to draw the production fluid into the lower barrel and to force the production fluid located in the upper barrel into the fluid conduit, wherein the actuating fluid and the production fluid are isolated from one another, wherein reducing the pressures of the actuating fluid within the central cavity enables the plunger assembly to move in a second direction, and wherein movement of the plunger assembly in the second direction moves the production fluid through the fluid passageway from the lower barrel to the upper barrel.

11. The pump assembly of claim 10, wherein the plunger assembly further comprises a second valve preventing flow of the production fluid from the upper barrel to the lower barrel through the fluid passageway.

12. The pump assembly of claim 10, wherein the pump assembly is configured for insertion into an tubing string, wherein the pump assembly further comprises a mating area configured for an attachment to the tubing string, and wherein the mating area prevents a fluid communication between the tubing string and the subsurface fluid reservoir through an annular space between the tubing string and the pump assembly.

13. The pump assembly of claim 11, wherein the actuating fluid located within the pump assembly between the upper and lower plungers is isolated from the production fluid located within the pump assembly above the upper plunger and below the lower plunger.

14. The pump assembly of claim 11, wherein the upper plunger comprises a length between twenty inches and ten feet.

15. The pump assembly of claim 11, wherein the plunger assembly moves within the pump assembly and the upper barrel and lower barrel comprise a length ranging from 8 feet to 40 feet each.

16. A pump assembly configured for insertion into a tubing string, the pump assembly comprising: an upper barrel fluidly connected to a lower barrel, wherein the upper barrel is fluidly connectable to a fluid conduit, and wherein the lower barrel is fluidly connectable to a fluid reservoir; a fluid passageway extending centrally within and through the entire length of the pump assembly and through the fluid conduit to a surface of a well;

a plunger assembly comprising an upper plunger movable within the upper barrel and a lower plunger movable within the lower barrel, wherein the upper plunger and the lower plunger are connected, and wherein a central cavity is formed within the upper barrel and the lower barrel between a bottom of the upper plunger and a top of the lower plunger and outside of a shaft connecting the upper plunger and the lower plunger, and the fluid passageway extends through a center of the upper plunger, a center of the lower plunger, and a center of the shaft connecting the upper plunger and the lower plunger; and wherein the plunger assembly is movable in an upward direction to draw a production fluid from the fluid reservoir into the lower barrel, wherein the plunger assembly is movable in a downward direction to force the production fluid from the lower barrel into the upper barrel through the fluid passageway, and wherein the plunger assembly is movable in the upward and the downward directions responsive to changes in pressure of an actuating fluid within the central cavity.

17. The pump assembly of claim 16, wherein the pump assembly further comprises: a traveling valve for preventing a downward flow of the production fluid through the fluid passageway; and a valve for preventing the production fluid from the lower barrel to the fluid reservoir.

18. The pump assembly of claim 16, wherein the upper plunger comprises a length between 0.50 meters (twenty inches) and 6.10 meters (ten feet).

19. The pump assembly of claim 18, wherein the upper and lower plungers are configured to move within the upper and lower barrels and the upper barrel and lower barrel comprise a length ranging from 2.44 meters (8 feet) to 12.2 meters (40 feet) each.

20. A method for pumping a production fluid from a fluid reservoir to a surface by using a pump assembly, comprising the steps of:

pressurizing an actuating fluid within a tubing string and a central cavity, thereby:

moving a plunger assembly in an upward direction, wherein the plunger assembly comprises an upper plunger, a lower plunger, and a connecting shaft between the lower plunger and the upper plunger, and the central cavity is between a bottom of the upper plunger and a top of the lower plunger;

forcing the production fluid from an upper portion of the pump assembly into a fluid conduit; and drawing the production fluid from the fluid reservoir into a lower portion of the pump assembly;

preventing the production fluid from flowing from the upper portion of the pump assembly into the lower portion of the pump assembly;

depressurizing the actuating fluid within the central cavity and the tubing string, thereby: enabling the plunger assembly to move in a downward direction; and forcing the production fluid from the lower portion of the pump assembly to the upper portion of the pump assembly through a fluid passageway extending through a center of the upper plunger, a center of the connecting shaft, and a center of the lower plunger, and through the fluid conduit to the surface;

preventing the production fluid from flowing from the lower portion of the pump assembly into the fluid reservoir; and isolating the actuating fluid within the tubing string from the production fluid in the upper and lower portions of the pump assembly.

21. The method of claim 20 including:

communicating the actuating fluid from the tubing string into the pump assembly to force the plunger assembly in the upward direction;

forcing the production fluid from an upper barrel into the fluid conduit;

drawing the production fluid from the fluid reservoir into a lower barrel;

forcing the production fluid from the lower barrel into the upper barrel through a fluid passageway extending through the entire length of the plunger assembly;

preventing the production fluid from flowing from the upper barrel into the lower barrel through the fluid passageway by using a first valve; and preventing the production fluid from flowing from the lower barrel into the fluid reservoir by using a second valve.

22. The method of claim 21 comprising: communicating the actuating fluid from within the tubing string into the pump assembly between the upper and the lower plungers of the plunger assembly; and isolating the actuating fluid between the upper and the lower plungers from the production fluid located in the fluid passageway.

* * * * *